US009011268B2

(12) United States Patent
Ban

(10) Patent No.: US 9,011,268 B2
(45) Date of Patent: Apr. 21, 2015

(54) MANUFACTURING METHOD AND GOLF CLUB HEAD

(71) Applicant: Bridgestone Sports Co., Ltd., Minato-ku, Tokyo (JP)

(72) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 120 days.

(21) Appl. No.: 13/800,296

(22) Filed: Mar. 13, 2013

(65) Prior Publication Data

US 2013/0303303 A1 Nov. 14, 2013

(30) Foreign Application Priority Data

May 11, 2012 (JP) ..... 2012-109890
May 11, 2012 (JP) ..... 2012-109891

(51) Int. Cl.
*A63B 53/04* (2006.01)
*B23P 17/00* (2006.01)

(52) U.S. Cl.
CPC ..... *A63B 53/04* (2013.01); *B23P 17/00* (2013.01); *A63B 2053/0425* (2013.01); *A63B 2053/0445* (2013.01); *A63B 2209/00* (2013.01); *A63B 53/047* (2013.01); *A63B 2053/0479* (2013.01); *A63B 2053/042* (2013.01)

(58) Field of Classification Search
CPC ..... A63B 2053/0445; A63B 2053/042; A63B 2053/0425; A63B 53/04
USPC ..... 473/330, 331
See application file for complete search history.

(56) References Cited

U.S. PATENT DOCUMENTS

| | | | | |
|---|---|---|---|---|
| 5,232,224 | A * | 8/1993 | Zeider | 473/345 |
| 5,358,249 | A | 10/1994 | Mendralla | |
| 6,001,032 | A | 12/1999 | Onuki et al. | |
| 7,717,801 | B2 | 5/2010 | Franklin et al. | |
| 7,841,952 | B1 | 11/2010 | Oldknow et al. | |
| 2001/0029208 | A1 | 10/2001 | Takeda | |
| 2010/0113179 | A1 * | 5/2010 | Solheim | 473/331 |
| 2011/0028241 | A1 | 2/2011 | Gilbert et al. | |
| 2012/0122606 | A1 * | 5/2012 | Yamamoto | 473/332 |

FOREIGN PATENT DOCUMENTS

| | | | |
|---|---|---|---|
| JP | 7-163688 | A | 6/1995 |
| JP | 9-084909 | A | 3/1997 |
| JP | 10-108927 | A | 4/1998 |
| JP | 11-042303 | A | 2/1999 |
| JP | 2001-293115 | A | 10/2001 |
| JP | 2009-131720 | A | 6/2009 |
| JP | 2011-502727 | A | 1/2011 |

* cited by examiner

*Primary Examiner* — Benjamin Layno
(74) *Attorney, Agent, or Firm* — Sughrue Mion, PLLC

(57) ABSTRACT

This invention provides a method of manufacturing a golf club head including a face surface. This manufacturing method includes a step of forming a plurality of recessed portions in the face surface, included in a first member, to extend in the toe-to-heel direction, a fixing step of fixing, to the recessed portions, second members which are formed by a material different from that of the first member, and fill the recessed portions, and after the fixing step, a scoreline forming step of forming at least one scoreline in each of the second members, while not forming the scoreline in a portion, between the recessed portions, of the face surface of the first member.

18 Claims, 8 Drawing Sheets

MANUFACTURING METHOD AND GOLF CLUB HEAD

BACKGROUND OF THE INVENTION 1. cl Field of the Invention

The present invention relates to a golf club head.

2. Description of the Related Art

It is a common practice to form a plurality of parallel linear grooves in the face surface of a golf club head to extend in the toe-to-heel direction (for example, Japanese Patent Laid-Open Nos. 10-108927 and 7-163688). These grooves are called, for example, scorelines, marking lines, or face lines (they will be referred to as scorelines in this specification). The face surface has a considerable influence on the impact performance. For this reason, techniques of forming a golf club head using a plurality of types of materials to improve an impact feel and the spin amount or flight distance of a struck golf ball have been proposed (for example, Japanese Patent Laid-Open Nos. 10-108927, 7-163688, and 2001-293115).

In general, if a golf club head is formed by a relatively soft material such as soft iron, an impact feel improves. However, when a soft material is used, portions surrounding scorelines are likely to wear. As portions surrounding scorelines wear more severely, the spin amount on a struck golf ball decreases. If a golf club head is formed by a hard material, portions surrounding scorelines become harder to wear, but an impact feel deteriorates.

SUMMARY OF THE INVENTION

It is an object of the present invention to make it possible to improve both an impact feel and the abrasion resistance of portions surrounding scorelines.

According to an aspect of the present invention, there is provided a method of manufacturing a golf club head including a face surface, the method comprising: a step of forming a plurality of recessed portions in the face surface, included in a first member, to extend in a toe-to-heel direction; a fixing step of fixing, to the recessed portions, second members which are formed by a material different from a material of the first member, and fill the recessed portions; and after the fixing step, a scoreline forming step of forming at least one scoreline in each of the second members, while not forming the scoreline in a portion, between the recessed portions, of the face surface of the first member.

According to another aspect of the present invention, there is provided a golf club head comprising: a first member including a face surface; a plurality of recessed portions formed in the face surface of the first member to extend in a toe-to-heel direction; and second members which are fixed to the recessed portions, are formed by a material different from a material of the first member, and fill the recessed portions, the second members each including at least one scoreline formed after the second members are fixed to the recessed portions, wherein the scoreline is not formed in a portion, between the recessed portions, of the face surface of the first member.

According to still another aspect of the present invention, there is provided a method of manufacturing a golf club head including a face surface, the method comprising: a step of forming a plurality of recessed portions in the face surface, included in a first member, to extend in a toe-to-heel direction; and a scoreline forming step of forming a scoreline in the face surface, wherein in the scoreline forming step, second members in each of which at least one scoreline is formed in advance, and which are formed by a material different from a material of the first member, and fill the recessed portions are fixed to the recessed portions, while the scoreline is not formed in a portion, between the recessed portions, of the face surface of the first member.

According to still another aspect of the present invention, there is provided a golf club head comprising: a first member having a face surface; a plurality of recessed portions formed in the face surface of the first member to extend in a toe-to-heel direction; and second members which are fixed to the recessed portions, are formed by a material different from a material of the first member, and fill the recessed portions, the second members each including at least one scoreline formed in advance before the second members are fixed to the recessed portions, wherein the scoreline is not formed in a portion, between the recessed portions, of the face surface of the first member.

Further features of the present invention will become apparent from the following description of exemplary embodiments with reference to the attached drawings.

DESCRIPTION OF THE EMBODIMENTS

<First Embodiment>

Figure 1:
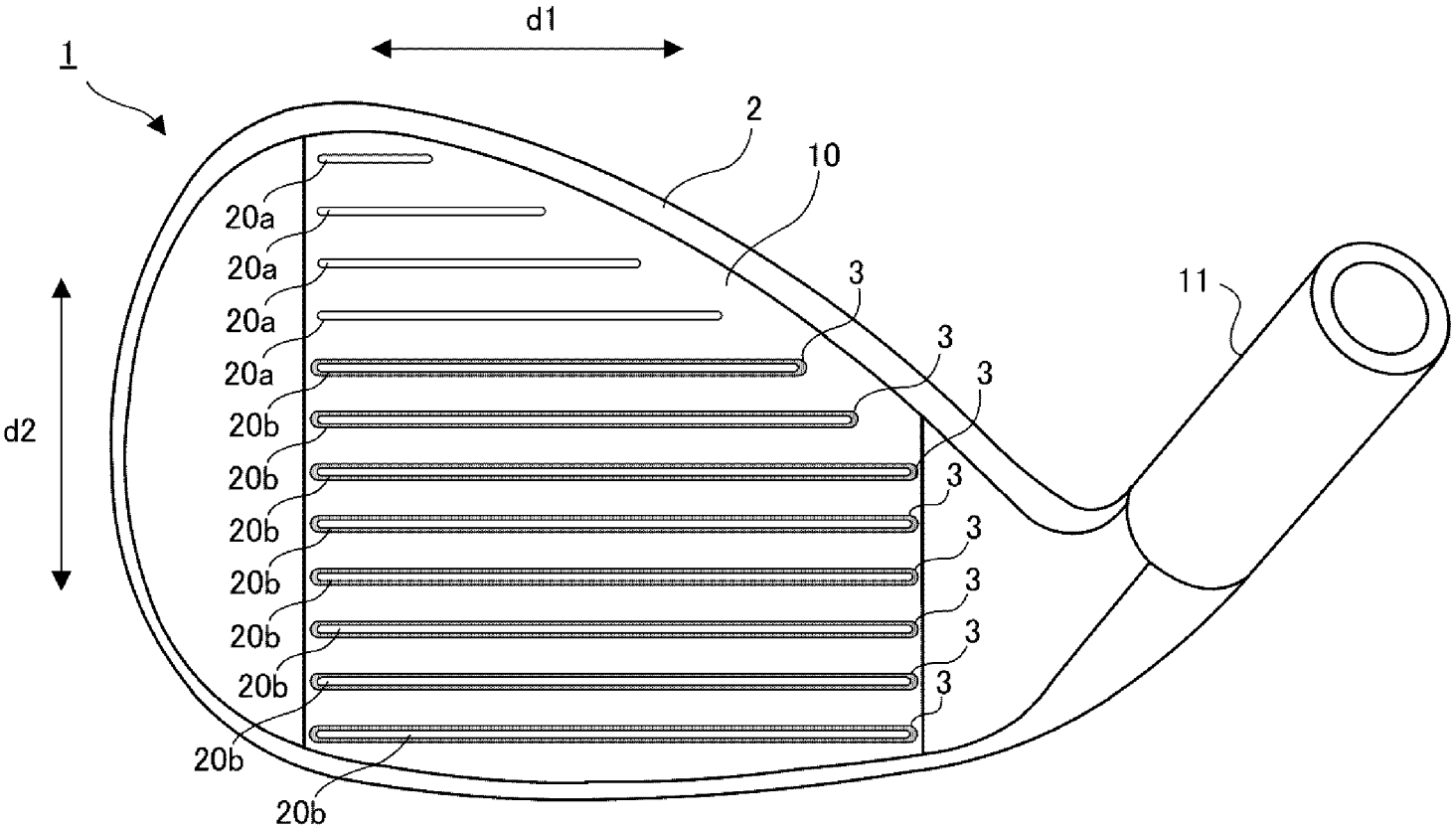
FIG. 1 is a perspective view of a golf club head according to an embodiment of the present invention.
Figure 2:
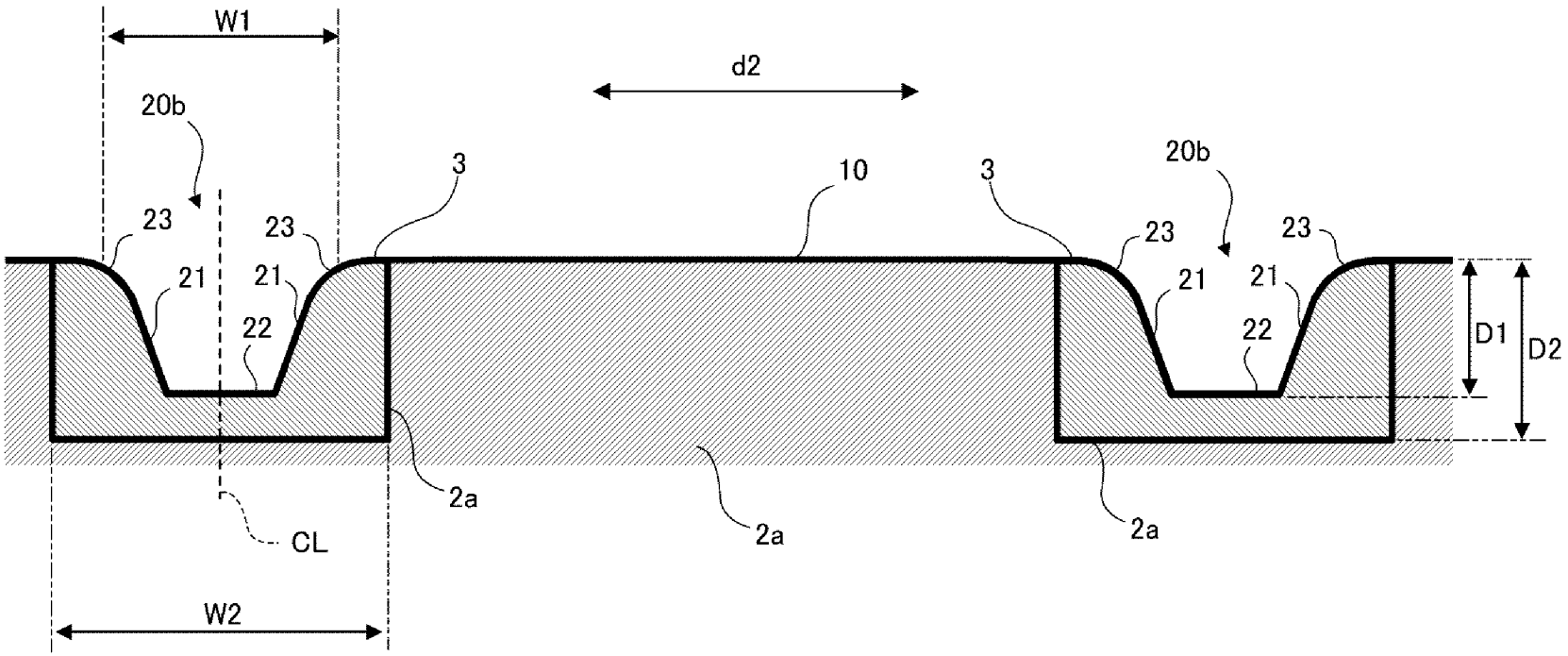
FIG. 2 is a sectional view of a face surface.

FIG. 1 is a perspective view of a golf club head 1 according to an embodiment of the present invention, and FIG. 2 is a sectional view of a face surface (striking surface) 10. Referring to FIGS. 1 and 2, a double-headed arrow d1 indicates the toe-to-heel direction, and a double-headed arrow d2 indicates a direction perpendicular to the direction d1. FIG. 2 is a sectional view of the face surface 10 along the direction d2.

This embodiment illustrates an example in which the present invention is applied to an iron golf club head. The present invention is suitable for an iron golf club head, and especially for middle iron, short iron, and wedge golf club heads. More specifically, the present invention is suitable for a golf club head with a loft angle of 30° (inclusive) to 70° (inclusive), and a head weight of 240 g (inclusive) to 320 g (inclusive). However, the present invention is also applicable to wood and utility (hybrid) golf club heads.

The golf club head 1 is formed by a plurality of types of members. In this embodiment, the golf club head 1 is formed by roughly two types of members. That is, the golf club head 1 includes a main body member 2 and a plurality of scoreline forming members 3. The main body member 2 includes the face surface 10 and a hosel portion 11, and forms portions other than the scoreline forming members 3. A shaft (not shown) is inserted into the hosel portion 11. Although the main body member 2 is formed by one member in this embodiment, it may be divided into two or more members. The main body member 2 may be formed by, for example, two members: a member including the face surface 10, and a member which forms the remaining portions.

A plurality of recessed portions 2*a* are formed in the face surface 10. The recessed portions 2*a* extend in the direction d1, and are aligned in the direction d2 to be parallel to each other. The scoreline forming members 3 are used to fill the recessed portions 2*a*, and fixed to the recessed portions 2*a*.

In this embodiment, the recessed portion 2*a* has a rectangular cross-sectional shape, and the scoreline forming member 3 also has a rectangular cross-sectional shape in conformity to the cross-sectional shape of the recessed portion 2*a*. The recessed portion 2*a* and scoreline forming member 3 may have cross-sectional shapes other than rectangular shapes, as a matter of course.

Pluralities of scorelines 20*a* and 20*b* are formed in the face surface 10. In this embodiment, the scorelines 20*a* are formed in the main body member 2, while the scorelines 20*b* are formed in the scoreline forming members 3. Although the cross-sectional shape of only the scoreline 20*b* is shown in FIG. 2, the scoreline 20*a* has the same cross-sectional shape.

The scorelines 20*a* and 20*b* are parallel linear grooves extending in the toe-to-heel direction (direction d1). Although the scorelines 20*a* and 20*b* are aligned at equal intervals (equal pitches) in this embodiment, they may be aligned at different intervals. In this embodiment, each of the scorelines 20*a* and 20*b* has the same cross-sectional shape throughout its entire longitudinal portion except for its two ends (toe- and heel-side ends). Also, the scorelines 20*a* and 20*b* have the same cross-sectional shape.

Each of the scorelines 20*a* and 20*b* includes a pair of side walls 21 and a bottom wall 22, and has a trapezoidal cross-sectional shape bilaterally symmetric about a center line CL. Note that the cross-sectional shapes of the scorelines 20*a* and 20*b* are not limited to a trapezoidal shape, and may be other shapes such as a V shape. Rounded portions are formed on edges 23 of each of the scorelines 20*a* and 20*b*. The radius of the rounded portion is, for example, 0.05 mm (inclusive) to 0.3 mm (inclusive).

A depth D1 of each of the scorelines 20*a* and 20*b* (the distance between the bottom wall 22 and the face surface 10) is preferably 0.3 mm or more. When the golf club head 1 is intended for athletics, the depth D1 is set to 0.5 mm or less to comply with a relevant rule. A width W1 (the width defined by the 30-degree measurement method) of each of the scorelines 20*a* and 20*b* is preferably 0.6 mm or more. When the golf club head 1 is intended for athletics, the width W1 is set to 0.9 mm or less to comply with a relevant rule.

The recessed portion 2*a* has a depth (the distance between the face surface 10 and the deepest portion) D2 and a width (the width in the direction d2) W2. The depth D2 and width W2 are preferably 1.2 times or more the depth D1 and width W1, respectively, to reliably form wall portions around the scorelines 20*b* to maintain their shapes.

The main body member 2 and scoreline forming members 3 are formed by different materials. To improve both an impact feel and the abrasion resistance of portions surrounding scorelines, a relatively soft material is used for the main body member 2, while a relatively hard material is used for the scoreline forming members 3. For example, the main body member 2 is formed by soft iron, while the scoreline forming members 3 are formed by maraging steel, stainless steel, a titanium alloy, ceramics, or a tungsten alloy. The scoreline forming members 3 may also be formed by a metal putty such as epoxy resin containing a metal powder.

The abrasion resistance of portions surrounding the scorelines 20*b* can be improved by forming the scoreline forming members 3 using a relatively hard material. If the golf club head 1 is formed only by a relatively hard material, an impact feel deteriorates. However, an impact feel can be improved using the scoreline forming members 3 in only the portions surrounding the scorelines 20*b*, and a relatively soft material for the main body member 2. The higher the area ratio of the main body member 2 to the golf club head 1, the better the impact feel becomes. Therefore, the weight percentage of the main body member 2 in the golf club head 1 is preferably 90% or more.

All scorelines may be formed by the scoreline forming members 3, instead of directly forming scorelines in the main body member 2. However, the number of process steps increases as the number of scoreline forming members 3 increases. Hence, in this embodiment, the scorelines 20*b* are formed by arranging the scoreline forming members 3 only in a region (the middle and lower portions of the face surface 10 in this embodiment) which is more likely to serve as striking points. On the other hand, the scorelines 20*a* are directly formed in the main body member 2 in a region (the upper portion of the face surface 10 in this embodiment), which is less likely to serve as striking points, without using any scoreline forming members 3.

As in this embodiment, when the face surface 10 is divided into three regions: the upper, middle, and lower portions in accordance with the number of scorelines, the scoreline forming members 3 are preferably disposed in the lower portion. If, for example, a total of 15 scorelines are formed, scorelines are preferably formed by the scoreline forming members 3 for five scorelines in the lower portion. Although the scoreline forming members 3 are preferably disposed in the middle portion, scorelines may be formed using the scoreline forming members 3 on only the lower portion side of the middle portion.

No scorelines are formed between the recessed portions 2*a*. In terms of abrasion resistance, it is preferable to directly form scorelines in the main body member 2 between the recessed portions 2*a* assumed to serve as regions which are more likely to serve as striking points.

A method of manufacturing a golf club head 1, and especially, a method of forming recessed portions 2*a* and scorelines 20*a* and 20*b* will be described next. The recessed portions 2*a* and scorelines 20*a* can be formed by, for example, forging, molding, cutting, or laser machining. The scorelines 20*b* can be formed by, for example, cutting or laser machining.

Figure 3:
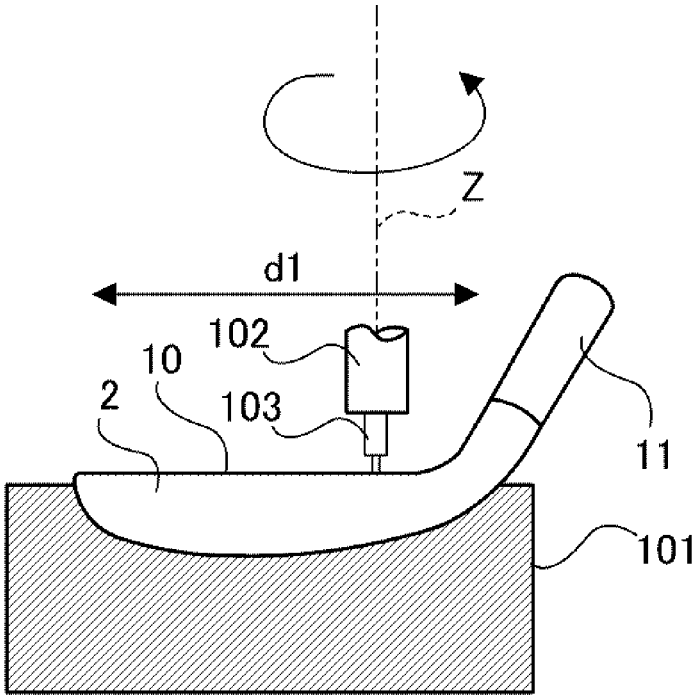
FIG. 3 is a view for explaining cutting by an NC milling machine.
Figure 4:
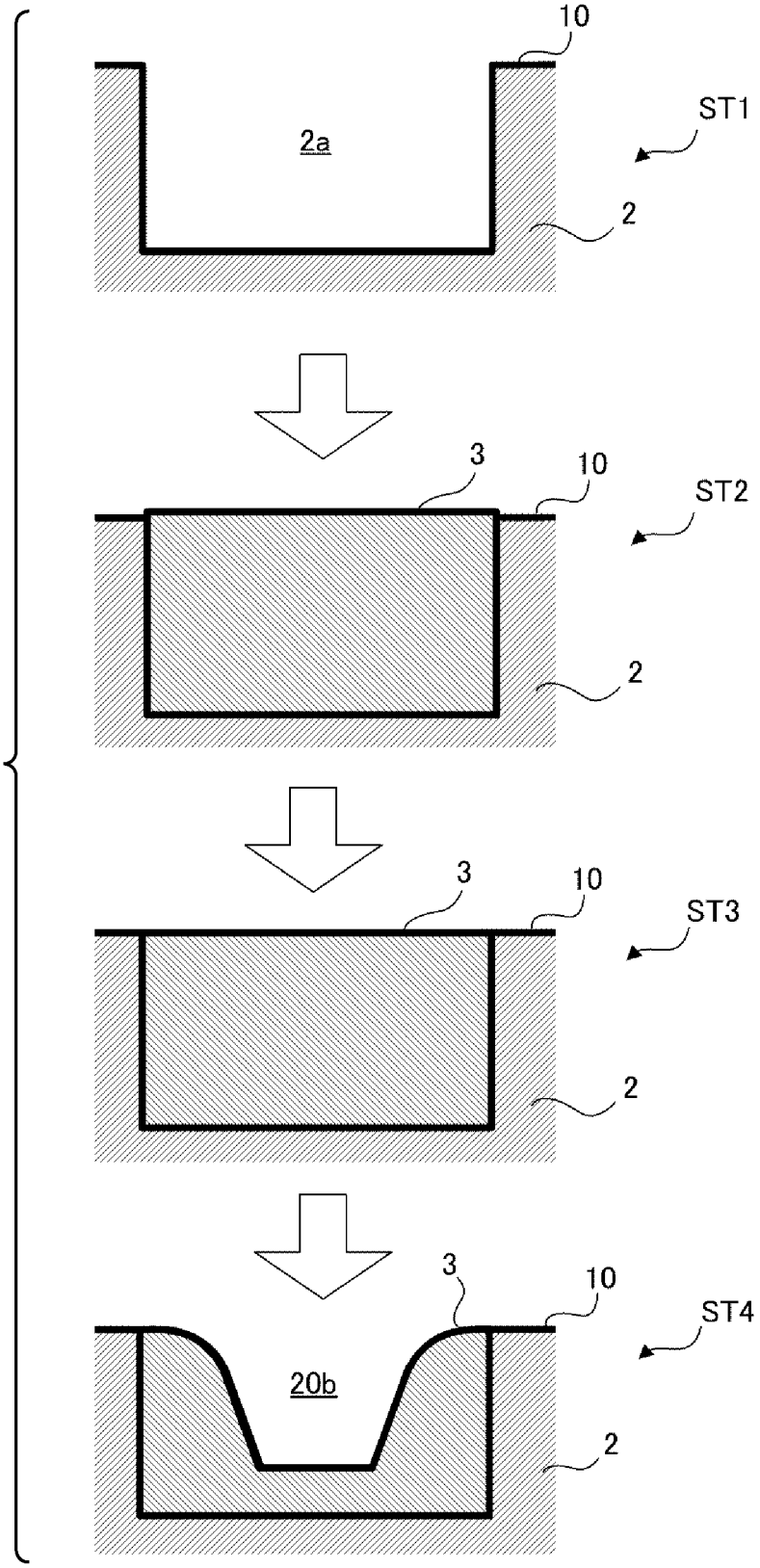
FIG. 4 shows views for explaining a method of manufacturing the golf club head shown in FIG. 1.
Figure 5:
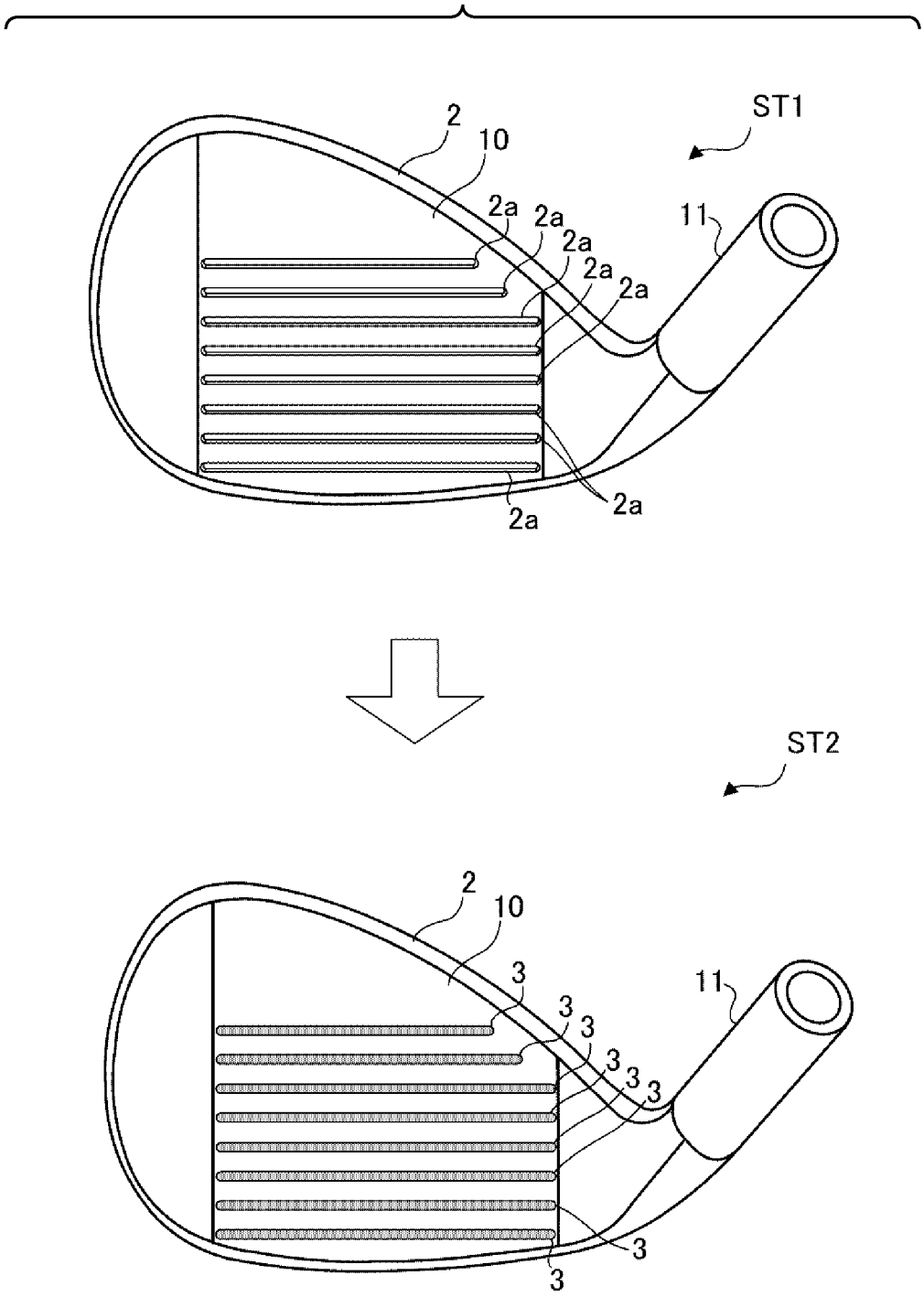
FIG. 5 shows views for explaining the method of manufacturing the golf club head shown in FIG. 1.

The case wherein both recessed portions 2*a* and scorelines 20*a* and 20*b* are formed by cutting will be described herein with reference to FIGS. 3 to 5. FIG. 3 is a view for explaining cutting by an NC milling machine. FIG. 4 shows views for explaining a method of manufacturing a golf club head 1 and, more specifically, sectional views taken along the direction d2 of a scoreline forming member 3 or a main body member 2 in respective steps. FIG. 5 shows overall views of the golf club head 1 in the course of manufacture.

First, a main body member 2 in which recessed portions 2*a* and scorelines 20*a* are to be formed, and scoreline forming members 3 in which scorelines 20*b* are to be formed are fabricated. Next, the main body member 2 is fixed to an NC milling machine via a jig 101, as shown in FIG. 3. The NC milling machine has a spindle 102 rotated about the Z-axis, and a cutting tool (end mill) 103 is attached to the lower end of the spindle 102. As the cutting tool 103, a cutting tool suitable for forming recessed portions 2*a* and scorelines 20*a* and 20*b* is selectively used.

First, recessed portions 2*a* are formed. More specifically, in the NC milling machine, the plane coordinates of a face surface 10 are set, and the face surface 10 is cut while relatively moving the face surface 10 or the cutting tool 103 in the toe-to-heel direction (direction d1) by rotating the spindle 102. When one recessed portion 2*a* is formed, the cutting tool 103 is separated from the face surface 10, and the next recessed portion 2*a* is formed upon relatively moving the cutting tool 103 in the direction (direction d2) in which the recessed portions 2*a* are aligned. With this operation, a plurality of recessed portions 2*a* are sequentially formed. In a state ST1 shown in FIGS. 4 and 5, the recessed portions 2*a* are formed in the face surface 10.

Next, scoreline forming members 3 which fill the recessed portions 2*a* are fixed to the recessed portions 2*a*, as shown in a state ST2 of FIGS. 4 and 5 (fixing step). In this step, scorelines 20*b* have not yet been formed in the scoreline forming members 3. As a fixing method, bonding, welding, brazing, or caulking is available. Alternatively, the scoreline forming members 3 may be molten into the liquid phase, injected into the recessed portions 2*a*, and hardened. Again, when a liquid material such as a metal putty is used for the scoreline forming members 3 as well, a liquid material mixed with a metal powder, and a hardening agent can be mixed with each other, injected into the recessed portions 2*a*, and hardened. In the fixing step, the main body member 2 may be temporarily removed from the NC milling machine.

After the fixing step, scorelines 20*a* and 20*b* are formed (scoreline forming step). In this process, undulations are often present on the edges of the scoreline forming members 3, as shown in the state ST2. Hence, before the scoreline forming step, a step of smoothening the face surface 10 may be performed to remove the undulations. In a state ST3 shown in FIG. 4, the undulations are removed. As a method of smoothening the face surface 10, a method of thinly cutting the entire face surface 10 using a relatively large cutting tool 103 is available. Alternatively, the face surface 10 may be smoothened by polishing, instead of cutting.

The process shifts to a scoreline forming step, in which scorelines 20*a* and 20*b* are formed. The scorelines 20*a* are formed in the main body member 2, while scorelines 20*b* are formed in the scoreline forming members 3. In a state ST4 shown in FIG. 4, the scorelines 20*b* are formed in the scoreline forming members 3. No scorelines 20*a* are formed between the recessed portions 2*a*.

A method of forming scorelines 20*a* and 20*b* is the same as that of forming recessed portions 2*a*. That is, the face surface 10 is cut while relatively moving the face surface 10 or the cutting tool 103 in the toe-to-heel direction (direction d1) by rotating the spindle 102. When one scoreline 20*a* or 20*b* is formed, the cutting tool 103 is separated from the face surface 10, and the next scoreline 20*a* or 20*b* is formed upon relatively moving the cutting tool 103 in the direction (direction d2) in which the scorelines 20*a* and 20*b* are aligned. With this operation, scorelines 20*a* and 20*b* are formed.

<Second Embodiment≤

Although one scoreline 20*b* is formed in one scoreline forming member 3 in the above-mentioned first embodiment, a plurality of scorelines 20*b* may be formed. In an example shown in FIG. 6A, two scorelines 20*b* are formed in a scoreline forming member 3A, in place of the scoreline forming member 3. With this arrangement, the total number of scoreline forming members 3A decreases, so the number of components of a golf club head 1 can be decreased. However, the exposed area of a main body member 2 in a face surface 10 reduces, so an impact feel deteriorates. Hence, when an impact feel is of great importance, it is preferable to form one scoreline 20*b* in one scoreline forming member 3A to reduce the thicknesses of the scoreline forming members 3A as much as possible. For example, a width W2 (see FIG. 2) of the scoreline forming member 3A is set twice or less a width W1 of the scoreline 20*b*.

Each recessed portion 2*a* may be a groove having at least one open end. In an example shown in FIG. 6B, recessed portions 2*a*' as a substitute for the recessed portions 2*a* are grooves open on the toe side of the main body member 2. Scoreline forming members 3B as a substitute for the scoreline forming members 3 have a shape conforming to that of the recessed portions 2*a*', and extend to the toe side of the main body member 2. With this arrangement, the scoreline forming members 3B can be inserted and assembled into the recessed portions 2*a*' from the toe side of the main body member 2. This increases the number of choices for the cross-sectional shapes of the scoreline forming member 3B and recessed portion 2*a*', compared to the above-mentioned first embodiment.

<Third Embodiment>

In the above-mentioned first embodiment, after the scoreline forming members 3 are fixed to the recessed portions 2*a*, and the scorelines 20*b* are formed in the scoreline forming members 3. In contrast to this, after scorelines 20*b* are formed in scoreline forming members 3 in advance, the scoreline forming members 3 having the scorelines already formed in them may be fixed to recessed portions 2*a*. A manufacturing method in the latter case will be described below.

Figure 7:
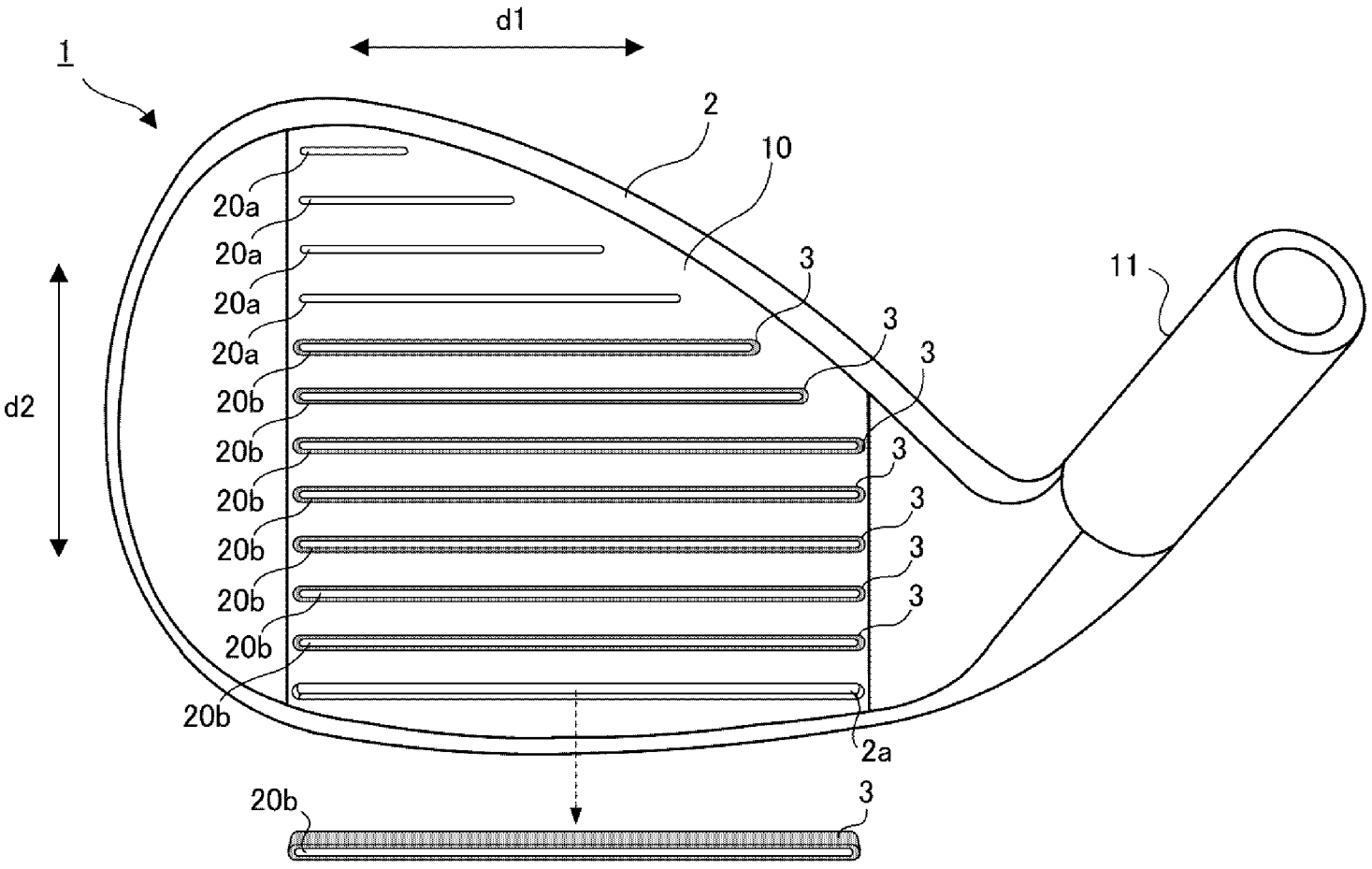
FIG. 7 is a partial exploded view of a golf club head according to another embodiment of the present invention.

FIG. 7 is a partial exploded view of a golf club head 1 according to this embodiment, and the golf club head 1 has the same arrangement except for a method of forming a golf club head 1 and scorelines 20*b* according to the above-mentioned first embodiment. Therefore, the same reference numerals as in the above-mentioned first embodiment denote the same constituent components in the third embodiment, and a description thereof will not be given. A different arrangement and manufacturing method will be described below.

As in the above-mentioned first embodiment, a plurality of recessed portions 2*a* are formed in a face surface 10. The recessed portions 2*a* extend in a direction d1, and are aligned in a direction d2 to be parallel to each other. The scoreline forming members 3 fill the recessed portions 2*a*, and are fixed to the recessed portions 2*a*. FIG. 7 shows the state in which one scoreline forming member 3 of eight scoreline forming members 3 is separated from a main body member 2, while the remaining seven scoreline forming members 3 are fixed to the recessed portions 2*a*.

In this embodiment as well, the main body member 2 and scoreline forming members 3 are formed by different materials. The same as in the above-mentioned first embodiment applies to the materials. For example, to improve both an impact feel and the abrasion resistance of portions surrounding scorelines, a relatively soft material is used for the main body member 2, while a relatively hard material is used for the scoreline forming members 3. For example, the main body member 2 is formed by soft iron, while the scoreline forming members 3 are formed by maraging steel, stainless steel, a titanium alloy, ceramics, or a tungsten alloy.

A method of manufacturing a golf club head 1, and especially, a method of forming recessed portions 2*a* and scorelines 20*a* and 20*b* will be described next. The recessed portions 2*a* and scorelines 20*a* can be formed by, for example, forging, molding, cutting, or laser machining. The scorelines 20*b* can be formed in advance by, for example, forging, molding, cutting, or laser machining.

Figure 8:
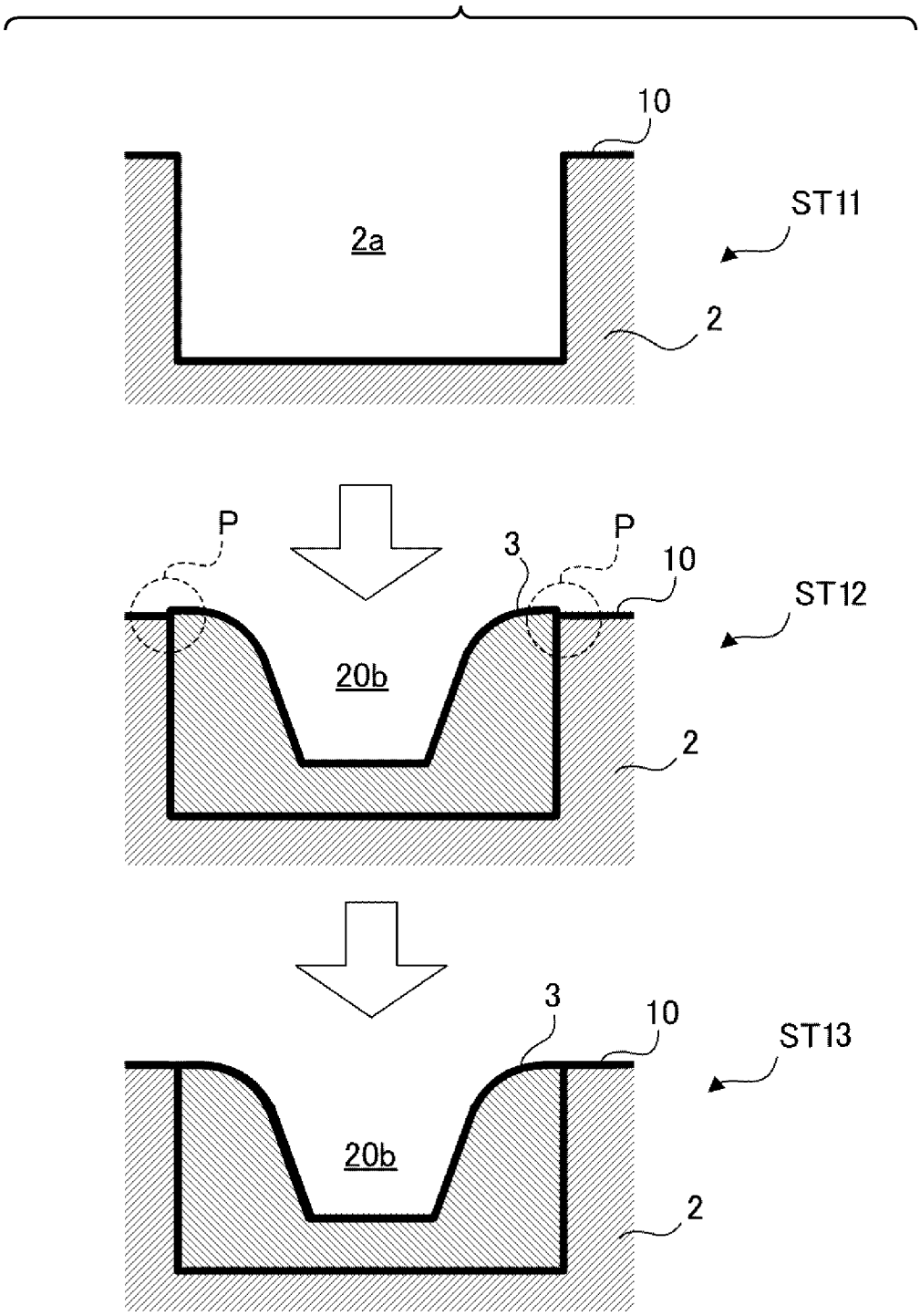
FIG. 8 shows views for explaining a method of manufacturing a golf club head shown in FIG. 7.

The case wherein both recessed portions 2*a* and scorelines 20*a* are formed by cutting will be described herein with reference to FIGS. 3 and 8. FIG. 3 is a view for explaining cutting by an NC milling machine, as described above. FIG. 8 shows views for explaining a method of manufacturing a golf club head 1 according to this embodiment and, more specifically, sectional views taken along the direction d2 of a scoreline forming member 3 or a main body member 2 in respective steps.

First, a main body member 2 in which recessed portions 2*a* and scorelines 20*a* are to be formed, and scoreline forming members 3 in which scorelines 20*b* are already formed are fabricated.

Next, as in the above-mentioned first embodiment, the main body member 2 is fixed to an NC milling machine via a jig 101, as shown in FIG. 3. The NC milling machine has a spindle 102 rotated about the Z-axis, and a cutting tool (end mill) 103 is attached to the lower end of the spindle 102. As the cutting tool 103, a cutting tool suitable for forming recessed portions 2*a* and scorelines 20*a* and 20*b* is selectively used.

First, recessed portions 2*a* are formed. More specifically, in the NC milling machine, the plane coordinates of a face surface 10 are set, and the face surface 10 is cut while relatively moving the face surface 10 or the cutting tool 103 in the toe-to-heel direction (direction d1) by rotating the spindle 102. When one recessed portion 2*a* is formed, the cutting tool 103 is separated from the face surface 10, and the next recessed portion 2*a* is formed upon relatively moving the cutting tool 103 in the direction (direction d2) in which the recessed portions 2*a* are aligned. With this operation, a plurality of recessed portions 2*a* are sequentially formed. In a state ST11 shown in FIG. 8, the recessed portions 2*a* are formed in the face surface 10.

Next, scorelines 20*a* and 20*b* are formed (scoreline forming step). The scorelines 20*a* are formed in the main body member 2, while the scorelines 20*b* are formed by fixing the scoreline forming members 3 to the recessed portions 2*a*.

A method of forming scorelines 20*a* is the same as that of forming recessed portions 2*a*. That is, the face surface 10 is cut while relatively moving the face surface 10 or the cutting tool 103 in the toe-to-heel direction (direction d1) by rotating the spindle 102. When one scoreline 20*a* is formed, the cutting tool 103 is separated from the face surface 10, and the next scoreline 20*a* is formed upon relatively moving the cutting tool 103 in the direction (direction d2) in which the scorelines 20*a* are aligned. With this operation, scorelines 20*a* are formed. No scorelines 20*a* are formed between the recessed portions 2*a*.

The scorelines 20*b* are already formed in the scoreline forming members 3. Hence, as the scoreline forming members 3 which fill the recessed portions 2*a* are fixed to the recessed portions 2*a*, the formation of the scorelines 20*b* is completed. In a state ST12 shown in FIG. 8, the scoreline forming members 3 are fixed to the recessed portions 2*a*. As a fixing method, bonding, welding, brazing, or caulking is available. In this fixing operation, the main body member 2 may be temporarily removed from the NC milling machine.

Undulations P are often present on the edges of the scoreline forming members 3. Hence, after the scoreline forming step, a step of smoothening the face surface 10 may be performed to remove the undulations P. In a state ST13 shown in FIG. 8, the undulations P are removed. As a method of smoothening the face surface 10, a method of thinly cutting the entire face surface 10 using a relatively large cutting tool 103 is available. Alternatively, the face surface 10 may be smoothened by polishing, instead of cutting.

Figure 6A:
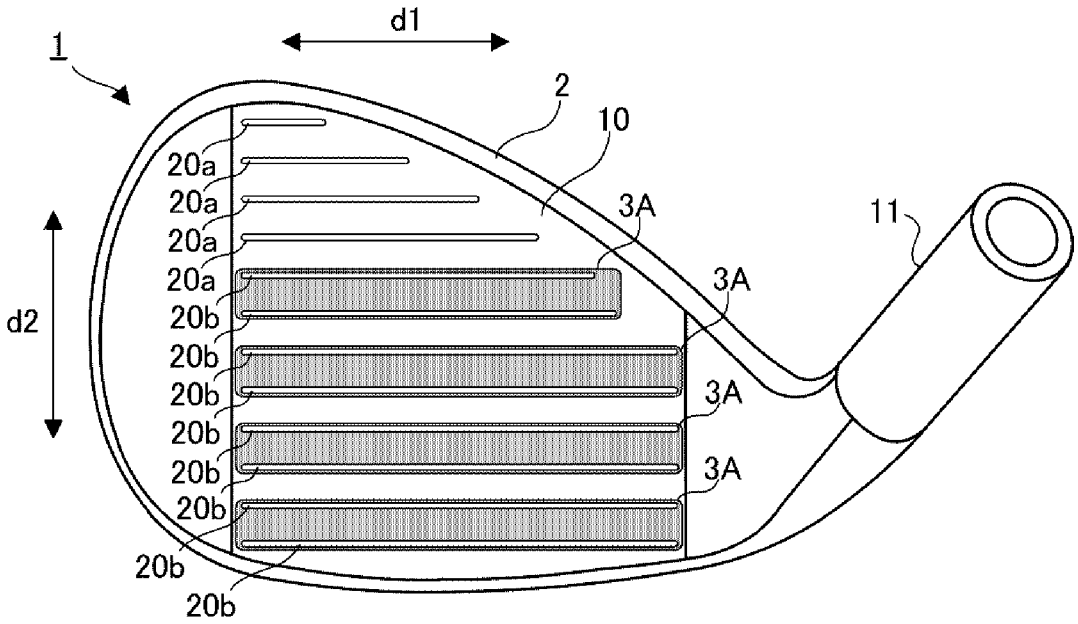
FIGS. 6A and 6B are views for explaining another embodiment.
Figure 6B:
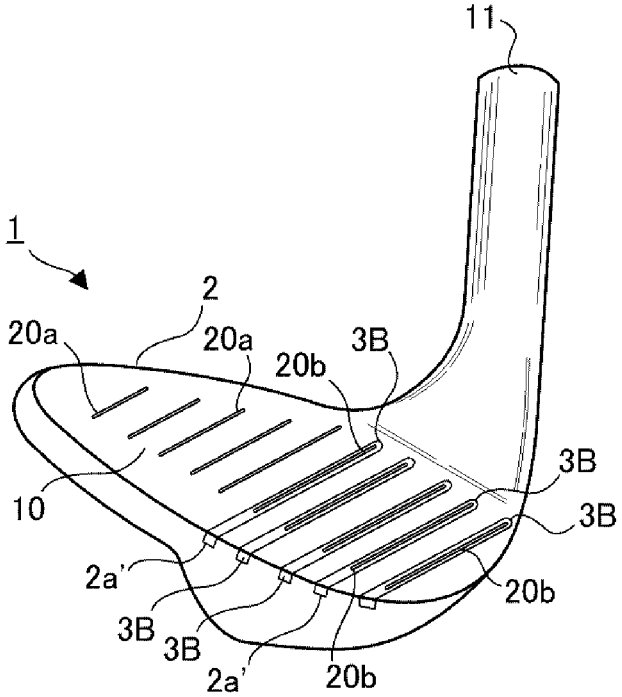

Although the third embodiment of the present invention has been described above, it is also possible to combine this embodiment with the above-mentioned second embodiment (an arrangement example shown in FIGS. 6A and 6B).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-109890, filed May 11, 2012, and No. 2012-109891, filed May 11, 2012, which are hereby incorporated by reference herein in their entirety.

What is claimed is:

1. A method of manufacturing a golf club head including a face surface, the method comprising:

a step of forming a plurality of recessed portions in the face surface, included in a first member, to extend in a toe-to-heel direction;

a fixing step of fixing, to the recessed portions, second members which are formed by a material different from a material of the first member, and fill the recessed portions; and after the fixing step, a scoreline forming step of forming at least one scoreline in each of the second members, while not forming the scoreline in a portion, between the recessed portions, of the face surface of the first member, wherein a weight percentage of the first member in the golf club head is not less than 90%.

2. The method according to claim 1, wherein one scoreline is formed in each of the second members.

3. The method according to claim 1, wherein the scoreline is not formed in the first member.

4. The method according to claim 1, wherein the second members are formed by a material harder than the material of the first member.

5. The method according to claim 1, wherein the recessed portions and the scorelines to be formed in the second members are formed by cutting.

6. The method according to claim 1, wherein a width of the recessed portion is not less than 1.2 times a width of the scoreline, and a depth of the recessed portion is not less than 1.2 times a depth of the scoreline.

7. The method according to claim 1, wherein the first member is formed by soft iron.

8. The method according to claim 1, further comprising a step of smoothening the face surface before the scoreline forming step.

9. A golf club head comprising:

a first member including a face surface;

a plurality of recessed portions formed in the face surface of said first member to extend in a toe-to-heel direction; and second members which are fixed to said recessed portions, are formed by a material different from a material of said first member, and fill said recessed portions, said second members each including at least one scoreline formed after said second members are fixed to said recessed portions, wherein said scoreline is not formed in a portion, between said recessed portions, of the face surface of said first member, and a weight percentage of the first member in the golf club head is not less than 90%.

10. A method of manufacturing a golf club head including a face surface, the method comprising:

a step of forming a plurality of recessed portions in the face surface, included in a first member, to extend in a toe-to-heel direction; and a scoreline forming step of forming a scoreline in the face surface, wherein in the scoreline forming step, second members in each of which at least one scoreline is formed in advance, and which are formed by a material different from a material of the first member, and fill the recessed portions are fixed to the recessed portions, while the scoreline is not formed in a portion, between the recessed portions, of the face surface of the first member, and a weight percentage of the first member in the golf club head is not less than 90%.

11. The method according to claim 10, wherein one scoreline is formed in each of the second members.

12. The method according to claim 10, wherein the scoreline is not formed in the first member.

13. The method according to claim 10, wherein the second members are formed by a material harder than the material of the first member.

14. The method according to claim 10, wherein the recessed portions and the scorelines to be formed in the second members are formed by cutting.

15. The method according to claim 10, wherein a width of the recessed portion is not less than 1.2 times a width of the scoreline, and a depth of the recessed portion is not less than 1.2 times a depth of the scoreline.

16. The method according to claim 10, wherein the first member is formed by soft iron.

17. The method according to claim 10, further comprising a step of smoothening the face surface after the scoreline forming step.

18. A golf club head comprising:

a first member having a face surface;

a plurality of recessed portions formed in the face surface of said first member to extend in a toe-to-heel direction; and second members which are fixed to said recessed portions, are formed by a material different from a material of said first member, and fill said recessed portions, said second members each including at least one scoreline formed in advance before said second members are fixed to said recessed portions, wherein said scoreline is not formed in a portion, between said recessed portions, of the face surface of said first member, and a weight percentage of the first member in the golf club head is not less than 90%.

* * * * *